US011370519B2

(12) United States Patent
Pettersson et al.

(10) Patent No.: US 11,370,519 B2
(45) Date of Patent: Jun. 28, 2022

(54) METHOD AND CONTROL APPARATUS FOR OPERATING A MARINE VESSEL

(71) Applicant: VOLVO PENTA CORPORATION, Gothenburg (SE)

(72) Inventors: Marcus Pettersson, Gothenburg (SE); Petter Andolf, Gothenburg (SE); Anders Thorin, Hindås (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 884 days.

(21) Appl. No.: 16/304,003

(22) PCT Filed: May 25, 2016

(86) PCT No.: PCT/EP2016/061775
§ 371 (c)(1),
(2) Date: Nov. 21, 2018

(87) PCT Pub. No.: WO2017/202458
PCT Pub. Date: Nov. 30, 2017

(65) Prior Publication Data

US 2019/0202541 A1 Jul. 4, 2019

(51) Int. Cl.
*B60L 3/00* (2019.01)
*B60L 15/00* (2006.01)
(Continued)

(52) U.S. Cl.
CPC ..... *B63H 21/213* (2013.01); *B63H 25/02* (2013.01); *B63H 25/42* (2013.01); *B63J 99/00* (2013.01);
(Continued)

(58) Field of Classification Search
CPC ..... B63H 21/213; B63H 25/02; B63H 25/42; B63H 2005/1254; B63H 2025/026; B63H 25/06; B63J 99/00
(Continued)

(56) References Cited

U.S. PATENT DOCUMENTS 4,691,659 A * 9/1987 Ito ..... B63H 21/213 114/144 R
4,747,359 A 5/1988 Ueno
(Continued)

FOREIGN PATENT DOCUMENTS

JP S62-008900 A 1/1987
JP S62055293 A 3/1987
(Continued)

OTHER PUBLICATIONS

English Translation for JP2008174173A (Year: 2021).*
Japan Office Action dated Jun. 9, 2020 in corresponding Japan Application No. 2018-562169, 2 pages.

*Primary Examiner* — Mahmoud S Ismail
(74) *Attorney, Agent, or Firm* — Venable LLP; Jeffri A. Kaminski

(57) ABSTRACT

A method for performing a sideway displacement of a marine vessel. The marine vessel includes a first and a second propulsion unit, a first and a second rudder respectively associated with the first and the second propulsion units, and a bow thruster. The first and the second propulsion units, the first and the second rudders and the bow thruster are operable via a single driver interface. The method includes the steps of; via the single driver interface operate the first and the second propulsion units and the bow thruster so as to provide a total thrust and set the rudder angles of the first and the second rudders, to thereby steer the displacement of the marine vessel during the sideway displacement.

23 Claims, 9 Drawing Sheets

(51) Int. Cl.

| | |
|---|---|
| ***G05D 1/00*** | (2006.01) |
| ***G05D 3/00*** | (2006.01) |
| ***G06F 7/00*** | (2006.01) |
| ***G06F 17/00*** | (2019.01) |
| ***B63H 21/21*** | (2006.01) |
| ***B63H 25/42*** | (2006.01) |
| ***B63H 25/02*** | (2006.01) |
| ***B63J 99/00*** | (2009.01) |
| *B63H 5/125* | (2006.01) |

(52) U.S. Cl.
CPC ..... *B63H 2005/1254* (2013.01); *B63H 2025/026* (2013.01)

(58) Field of Classification Search
USPC ..... 701/21
See application file for complete search history.

(56) References Cited

U.S. PATENT DOCUMENTS

| | | | | |
|---|---|---|---|---|
| 6,361,387 | B1 | 3/2002 | Clarkson | |
| 2010/0121505 | A1* | 5/2010 | Yamazaki | G05D 1/0206 701/21 |
| 2010/0186648 | A1* | 7/2010 | Wobben | B63H 25/38 114/39.3 |
| 2013/0072076 | A1* | 3/2013 | Pellegrinetti | B63H 5/125 440/1 |
| 2014/0352595 | A1 | 12/2014 | Yuet et al. | |

FOREIGN PATENT DOCUMENTS

| | | | | |
|---|---|---|---|---|
| JP | S62008898 | A | | 7/1988 |
| JP | H02-127190 | A | | 5/1990 |
| JP | 2007022422 | A | | 2/2007 |
| JP | 2008174173 | A | * | 7/2008 |
| SE | 520445 | C2 | | 7/2003 |
| WO | 02085702 | A1 | | 10/2002 |

* cited by examiner

METHOD AND CONTROL APPARATUS FOR OPERATING A MARINE VESSEL

CROSS-REFERENCE TO RELATED APPLICATIONS

This application is a U.S. National Stage application of PCT/EP2016/061775, filed May 25, 2016 and published on Nov. 30, 2017 as WO2017/202458.

TECHNICAL FIELD

The present invention relates to a method for performing a sideway displacement of a marine vessel using a single driver interface and an arrangement in the form of a steering arrangement for executing the method. The marine vessel comprises a bow thruster and a first and a second propulsion unit. Each propulsion unit is associated with a rudder, whereby the rudders are set as a function of a total thrust, to thereby steer the displacement of the marine vessel during the sideway displacement.

BACKGROUND

Joystick steering of marine vessels has been significantly improved when the Inboard Performance System IPS was introduced. Dual counter rotating propellers provided with steerable pods enable an exact joystick steering and docking as compared to traditional inboard shafts having non steerable propellers. IPS provides a marine vessel driver with a number of advantages such as joystick docking, joystick driving dynamic positioning system, autopilot capabilities, sportfish mode and interceptor systems just to mention a few.

The US patent publication no. 2014/352595 A1 discloses a method for steering a marine vessel using a first and a second propulsion unit. The method includes the steps of receiving a first signal from a left control lever and a second signal from a right control lever, and dependent on the relative size of these signals, activate a clock-wise turning moment or a counter clock-wise turning movement. However, as new and improved technology progresses little efforts are put into traditional technology. Little efforts are put into rudder control during maneuvering as new and improved propeller maneuvering provides such great advantages.

An early attempt in providing an apparatus for steering a marine vessel using a joystick was presented in the U.S. Pat. No. 4,691,659 A. The ship steering apparatus comprised a pair of rotation angle detectors for detecting the rotation angles around two X and Y axes from the motion of a joystick lever. Based on the movement of the joystick lever, a ship steering command could be calculated. The calculated steering command could thereafter be used to command the marine vessel.

It has lately been found that there is a need for an improved marine vessel steering control during displacement of the marine vessel especially when the marine vessel is joystick controlled. There is a need for a method which provides a relatively low cost option to improve marine vessel control during joystick maneuvering and especially for marine vessels having no steerable stern drives.

SUMMARY

An object of the invention is to provide a method for performing a sideway displacement of a marine vessel, which method is easy to implement in a marine vessel and at a relatively low cost. The object is achieved by a method according to claim 1. More precisely is the object achieved by a method for performing a sideway displacement of a marine vessel, the marine vessel comprising a first and a second propulsion unit, a first and a second rudder respectively associated with the first and the second propulsion units, and a bow thruster. The first and the second propulsion units, the first and the second rudders and the bow thruster are operable via a single driver interface. The method comprises via the single driver interface;

operate the first and the second propulsion units and the bow thruster so as to provide a total thrust and, setting the rudder angles of the first and the second rudders, to thereby steer the displacement of the marine vessel during the sideway displacement.

By the provision of the above method for performing a sideway displacement of a marine vessel, the method enables a marine vessel to perform a smooth sideway displacement which is assisted by both rudders. The method is specifically advantageous when applied in a marine vessel having twin fixed inboard propulsion units, i.e. marine vessels having non-steerable propellers, and especially for docking maneuverers. The method further integrates the operation of the first and the second propulsion unit, the transmissions of the first and the second propulsion unit, the bow thruster with the first and the second rudder into a single control function via the single driver interface such as a joystick. Further, the present invention also provides an inexpensive arrangement that can assist the driver to manoeuvre the marine vessel to turn and displace the marine vessel sideways e.g. during docking. The method enables the possibility to perform a sideway displacement without the need of a stern thruster. The method and the arrangement enable a smooth and relatively precise operation of the marine vessel.

The method may comprise the step of setting a function between the rudder angles and the level of thrust of at least the bow thruster. Just as a matter of example, the higher the thrust, the higher the rudder angles may be set. Preferably the rudders are however not exceeding 20° port or starboard. This enables the option of setting a proportional and linear relation between the rudder angles and the level of thrust of the bow thruster together with the propulsion from the propulsion units if desired. The mentioned function may thus be a mapped function such as a linear function or a non-linear function.

According to an embodiment, the rudder angles may be set to 0-20° port or starboard. It has been found that the rudder angles should not exceed 20° port or starboard as this may affect the balancing of the marine vessel during the sideway displacement in a negative manner.

The method may comprise the step of setting the rudder angles of the first and the second rudders as a function of the total thrust. By setting the rudder angles as a function of the total thrust, the single driver interface will effectively operate as steering device of the rudders and synchronize these with the thrust the marine vessel is subjected to via the first and the second propulsion units and the bow thruster. The step removes the need for individual steering of the rudders by the driver when performing the sideway displacement.

The first and the second propulsion units may each have a forward, a reverse and optionally a neutral gear. The gears may be selected automatically in dependence of a driver operating the single driver interface. This provides a combined control of the transmissions and associate that control with the rudder control via the single driver interface.

The method may be performed at a first level of thrust, and subsequently at a second level of thrust. The first level of thrust is preferably a low speed displacement and the second level of thrust is preferably a high speed displacement. The terminology low speed and high speed as used herein is meant to be understood in relative terms during a sideway displacement. A low speed sideway displacement may be a speed of 0.5 knots, and a high speed sideway displacement may be a speed of 1.5 knots. The speed may be measured as the speed over ground at zero currents and zero wind.

The sideway displacement may be substantially a parallel sideway displacement, i.e. a sway motion, or a parallel sideway displacement, i.e. a pure sway motion. It has been found that the step is advantageously performed as a straight starboard or straight port sway motion. Additional displacement maneuvers may be performed in order to set the rudder angles. Just as a matter of example, the method may comprise a low speed and a high speed displacement of a selected of number maneuvers to set the relation between the rudder angles and the total thrust.

At the first level of thrust, the rudder angles of the first and the second rudders may be set to substantially 0°, or to 0°. Setting the rudder angles to substantially 0°, or to 0° provide a maximum stern resistance during the sideway displacement enables a balancing between the maximum stern resistance and the bow thruster. This is specifically advantageous when the first level of thrust corresponds to a low speed displacement of the marine vessel.

At the second level of thrust, the rudder angles of the first and the second rudders may be set substantially parallel, or parallel, and at a rudder angle of 5-20° port or starboard.

Suitable rudder angles may vary dependent on the hull, the rudder size and shape. Suitable rudder angles may preferably be 6-13° port or starboard such as 6°, 7°, 8°, 9°, 10°, 11°, 12° or 13°. This is specifically advantageous when the second level of thrust corresponds to a high speed displacement of the marine vessel. The second calibration step may be high speed displacement and the sideway displacement may be substantially a parallel sideway displacement, or a parallel sideway displacement.

At the second level of thrust, the bow thruster may be set to at least 75% of maximum thrust. It is advantageous to set a high level of bow thrust as this brings the conditions closer to the extremes. Other suitable levels are at least 80, 85, or 90% of maximum thrust. It is however advantageous not to exceed 90% of maximum thrust as it may be desirable to enable the driver with a degree of manual compensation. Just as a matter of example, a driver performs a sideway displacement of the marine vessel in accordance with the method disclosed herein and the marine vessel is subjected to a cast wind, or a temporarily current change, the driver may want to manually balance the sideway displacement using the single driver interface. This may be achieved by not using the maximum thrust available but setting a relatively high level of thrust such as 75-90% of maximum thrust as second level of thrust.

The first and the second rudders may be operated to be parallel with respect to each other during the sideway displacement. It may be noted however that small deviations may be permitted. The method may for example include a step by which one of the rudders is temporarily slightly offset with respect to the other rudder. Just as a matter of example, the offset may be up to 5° port or starboard, but not more. An offset such as this may be used to compensate for a temporary loss of power in one of the propulsion units during displacement for example. In a similar manner, the method may include a step by which one of the rudders is permanently slightly offset with respect to the other rudder. Such offset may be done to compensate for the marine vessels hydrodynamics for example. It should be noted that a permanent offset may be changed, or updated, continuously. Just as matter of example, a permanent offset may be updated once a month in order to compensate for fouling of the hull, the rudders, or the propellers.

According to an aspect, the total thrust may be provided by a thrust of the bow thruster and a forward thrust of the first propulsion unit and a rearward thrust of the second propulsion unit. Optionally a rearward thrust of the first propulsion unit and a forward thrust of the second propulsion unit. The option of being able to control both rudders together with all the thrusters in a combined manner gives a smooth operation.

The first and the second propulsion units may have fixed thrust directions. The fixed thrust directions may be forward and reverse, for instance forward and reverse only. By the term fixed thrust direction as used herein is meant that the propulsion units are non-steerable. The propulsion units may be provided with inboard shafts having non steerable propellers. The marine vessel may have an inboard shaft line installation comprising a first and a second inboard shaft associated with the first and the second propulsion units respectively for example. The pitch angle of the propellers and/or the rotational speed may however still be manipulated even if the thrust directions are fixed.

The sideway displacement may be a sideway docking displacement. The method is specifically useful for docking maneuvers. As the method provide for smooth operation and a more balanced operation of the marine vessel, the method is highly useful for docking maneuvers or for calibrating the rudder angles for docking maneuvers.

The single driver interface may be a joystick, touch pad or the like. By the term single driver interface is herein meant that at least steering and throttle can be operated via one single device, preferably also the transmission of the propulsion units, i.e. switching between forward, reverse and neutral gear.

As mentioned, the single driver interface may be a joystick. The change of rudder angles of the first and the second rudders are preferably associated with the rotation and/or tilting of the joystick.

It has been found that the method for performing a sideway displacement of the marine vessel method may advantageously be used a calibration method. The method may be used to calibrate rudder angles of the first and the second rudders as a function of the total thrust. The method enables the settings of the rudders during preferably at least two distinct maneuvers between which a relationship may be derived between the suitable rudder angles and a proper balance during the sideway displacement of the marine vessel. The rudder angles at a first level of thrust, and the rudder angles at a second level of thrust may be stored on a storage device. Via an algorithm of a steering and throttle control module, the rudder angles may thereafter be set as a function based on the stored values, preferably a linear function.

According to an aspect, the method may comprise the step of controlling and/or displacing the first and the second rudders to set the rudder angles. It is advantageous to control both the rudders using the single driver interface; this provides a smooth displacement which also enables both the rudders to be steered during displacement. The rudders may be controlled and/or displaced substantially in parallel together. The set rudder angles of the first and the second rudders are preferably more than 0°.

According to an aspect, the disclosure also relates to a computer program comprising program code means for performing any one of the steps when the program is run on a computer, and a computer readable medium carrying a computer program comprising program code means for performing any one of the steps when the program product is run on a computer.

According to an aspect, the objects are also at least partly achieved by a marine vessel single driver interface steering arrangement for implementing the method disclosed herein. The marine vessel single driver interface steering arrangement comprising at least a first and a second propulsion unit, a first and a second rudder respectively associated with the first and the second propulsion units, and a bow thruster. The marine vessel single driver interface steering arrangement is configured to enable a sideway displacement of a marine vessel via the single driver interface by operating the first and the second propulsion units and the bow thruster so as to provide a total thrust, and optionally setting the rudder angles of the first and the second rudders as a function of the total thrust, to thereby steer the displacement of the marine vessel during the sideway displacement.

The first and the second propulsion units may have fixed thrust directions. As mentioned above, the first and the second propulsion units are preferably stern propulsion units. The first and the second rudders are preferably positioned so that they intersect with the thrust direction formed by the first and the second propulsion unit respectively, i.e. the thrust from the first propulsion unit should be directed towards the first rudder when the first propulsion is in forward gear. Likewise, the thrust from the second propulsion unit should be directed towards the second rudder when the second propulsion unit is in forward gear.

The marine vessel may comprise an inboard shaft line installation comprising a first and a second inboard shaft associated with the first and the second propulsion units respectively. The rudder angles of the first and the second rudders may be set as a function of the total thrust.

The marine vessel single driver interface steering arrangement may comprise a memory module for storing data relating to the rudder angles. The data may be used to calibrate the marine vessel single driver interface steering arrangement so that the angle of the rudders can be operated via the single driver interface. The marine vessel single driver interface steering arrangement can be calibrated using the disclosed method.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION OF EXAMPLE EMBODIMENTS OF THE INVENTION

Figure 1:
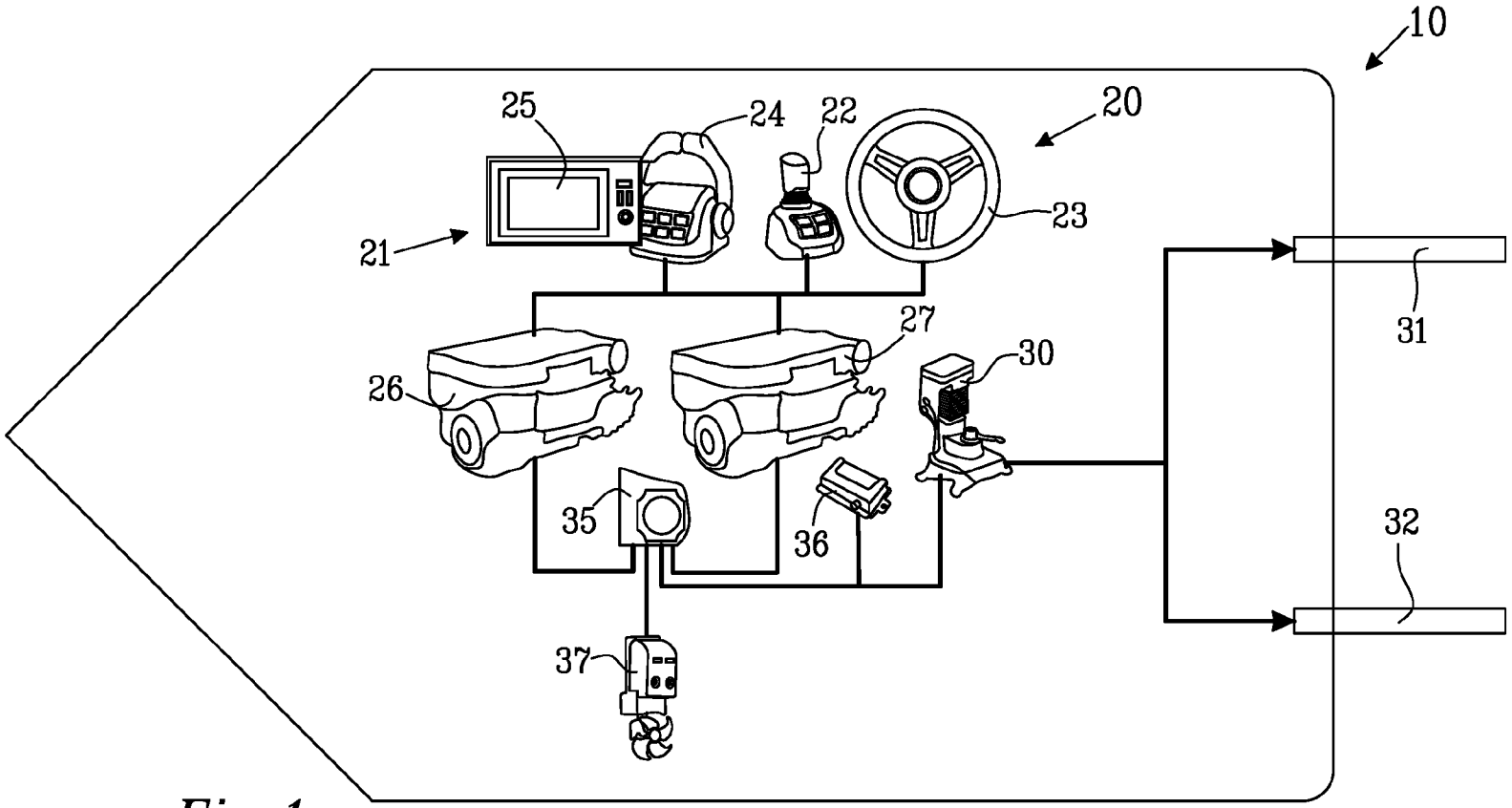
FIG. 1 shows a schematic overview of a marine vessel having a steering and propulsion arrangement.

FIG. 1 shows a schematic overview of a marine vessel 10 and a steering and propulsion arrangement 20 for operating the marine vessel 10. The steering and propulsion arrangement 20 comprises a helm station 21. The helm station 21 is provided with a joystick 22, a steering wheel 23, throttles 24 and instrument and navigational data interface 25. The joystick 22 represents a single driver interface. A single driver interface enables a driver of the marine vessel to operate the steering and the propulsion of the marine vessel in a desired direction using only one single driver interface. A joystick is an example of such single driver interface. Another example is a touch pad interface representing a virtual joystick.

A rudder actuator 30 such as an electrical rudder actuator is operatively connected to a first and a second rudder 31, 32 and controlled via the joystick 22 and/or the steering wheel 23. It should be noted that the rudder actuator 30 could one or more individual rudder actuators. Each rudder 31, 32 could be provided with an individual rudder actuator for example, or use one common rudder actuator. The first and the second rudders 31, 32 are also referred to as port and starboard rudder 31, 32. The rudder actuator 30 governs the positioning of the first and the second rudder 31, 32 as a response to an input signal to the electrical rudder actuator. A first and a second propulsion unit 26, 27 is arranged in working cooperation with a first and a second propeller (not shown). The first and the second propulsion units 26, 27 are also referred to as port propulsion unit 26 and starboard propulsion unit 27. The first and the second propulsion units are stern propulsion units. A steering and thruster control module 35 operates as an integrating hub between the helm station 21 and the rudders and the first and the second propulsion units 26, 27. A navigation unit 36 such as an electronic compass and GPS device provides navigational data. The steering and propulsion arrangement 20 further comprises a bow thruster 37 positioned in the bow of the marine vessel 10. A bow thruster is located forward of the midship of the marine vessel, preferably in the proximity of the bow. The first and the second rudders 31, 32 are preferably positioned so that they intersect with the thrust direction formed by the first and the second propulsion unit 26, 27 respectively, i.e. the thrust from the first propulsion unit 26 should be directed towards the first rudder 31 when the first propulsion is in forward gear. Likewise, the thrust from the second propulsion unit 27 should be directed towards the second rudder 32 when the second propulsion unit 27 is in forward gear.

A method according to the present invention will use the propulsion units, gears and thruster together with the rudders to balance the marine vessel during displacement in an efficient manner. The method offers the possibility to maneuver the marine vessel sideways and in transversal directions without the need for stern thrusters. The method may thus be implemented on marine vessels having non steerable propellers, i.e. fixed stern drives, i.e. stern drives which cannot be rotated. It is of course possible to apply the disclosed method on marine vessels having rotatable stern drives. That may be useful if the rotatable stern drives are temporarily fixed or blocked. The method will be disclosed in greater detail with reference to the figures below. The propulsion units 26, 27 may be combustion engines such as diesel engines, or electrical motors connected to batteries, fuel cells or the like, or hybrid motors. The propulsion units may impart the thrust via propellers and/or jet propulsion.

Figure 2:
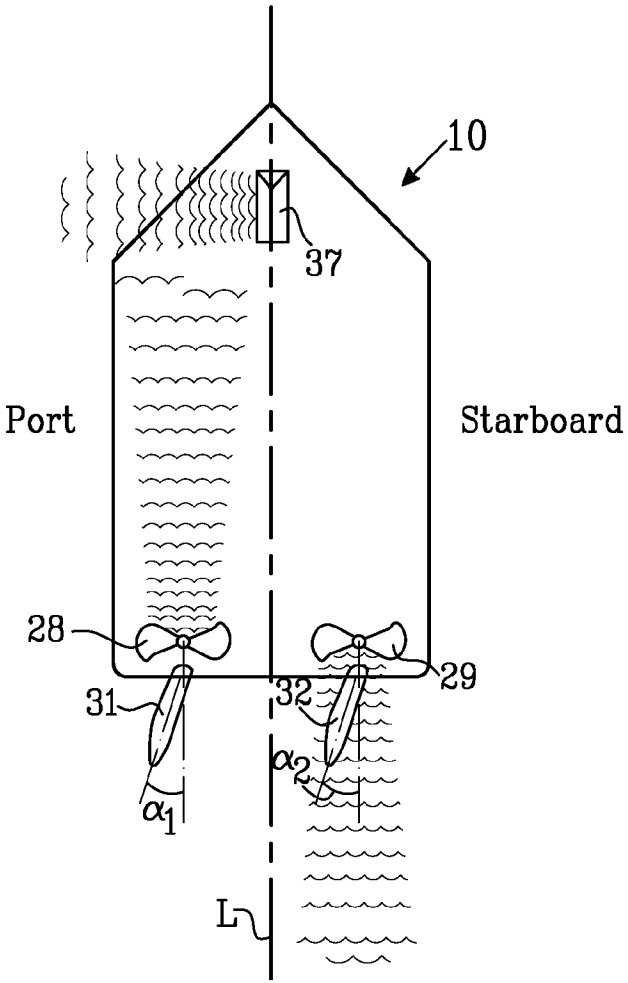
FIG. 2-9 show the marine vessel performing different maneuvers while illustrating thrust directions and joystick control.
Figure 2:
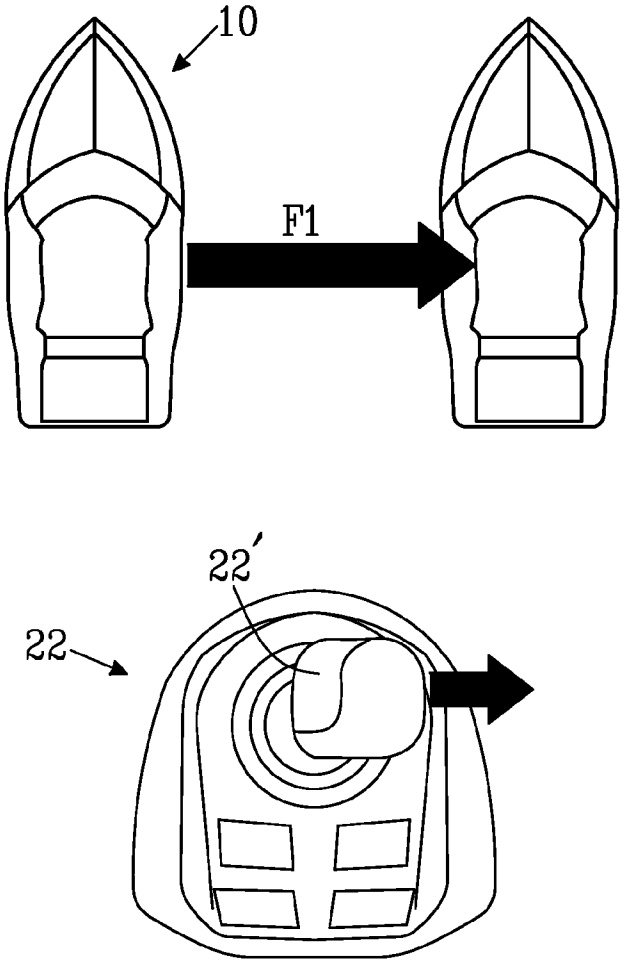

FIG. 2 shows the marine vessel 10 during a sideway displacement maneuver. FIG. 2 shows the marine vessel 10 illustrated before and after the displacement, and the displacement direction F1 between the end positions. FIG. 2 also show the joystick 22, representing the single driver interface, and how the joystick 22 is operated to maneuver the marine vessel 10. The joystick 22 comprises a lever 22'. Further shown is a schematic illustration of the marine vessel 10 with a view from above and with the thrust forces imparted by the first and the second propulsion units 26, 27 (not shown) via a first and a second propeller 28, 29 respectively, and the bow thruster 37.

By operating the first and said second propulsion units 26, 27 and the bow thruster 37, a total thrust is provided. The total thrust is the thrust resulting from the individual thrusts which act on the marine vessel 10. The individual thrusts are illustrated by the force lines originating from the port and the starboard propellers 28, 29 and the bow thruster 37. The rudder angles $\alpha$ will further be set as a function of the total thrust, to steer the displacement of the marine vessel during a displacement such as during a sideway displacement.

The rudder angle is set with respect to the longitudinal center line L of the marine vessel, and is expressed as the angle of the rudder when view from above and the longitudinal axis L as indicated in FIG. 2. The rudder angle $\alpha$ is expressed as a port angle and a starboard angle starting from zero degrees when the rudder is parallel with the longitudinal center line L of the marine vessel. FIG. 2 shows the first and the second rudders 31, 32 being tilted with 10 degrees port angle, hence $\alpha 1$=10° port and $\alpha 2$=10° port. The position of the first and the second rudders 31, 32 correspond to the joystick side position to increase/decrease side thrust, and can optionally be centered when the joystick is released.

With reference to FIG. 2, the joystick 22 is operated by a driver by tilting the joystick 22 to starboard commanding the marine vessel 10 to be displaced sideways as indicated by the arrow F1. The bow thruster 37 is propelling the bow of the marine vessel 10 in a starboard direction and thus imparting a thrust illustrated by the force lines at port. The port propeller 28 imparts a forward thrust and the starboard propeller 29 imparts a rearward thrust. The first propulsion unit 26 is thus in reverse gear and the second propulsion unit 27 is in forward gear. The first and the second rudders 31, 32 are set as a function of the total thrust to steer the displacement, i.e. to balance the displacement. The first and the second rudders 31, 32 each have a rudder angle $\alpha 1$, $\alpha 2$ with respect to a longitudinal axis L of the marine vessel 10. The throttle will correspond to the current joystick starboard side position, idle when joystick is released as the joystick will return to neutral position. In several, embodiments disclosed herein, it may be preferred that the magnitude of the thrust produced by each one of the first and the second propulsion units and the bow thruster is such that the thrusts together produce a yaw moment that is lower than a predetermined value, preferably close to zero, and also Fx=0.

Figure 3:
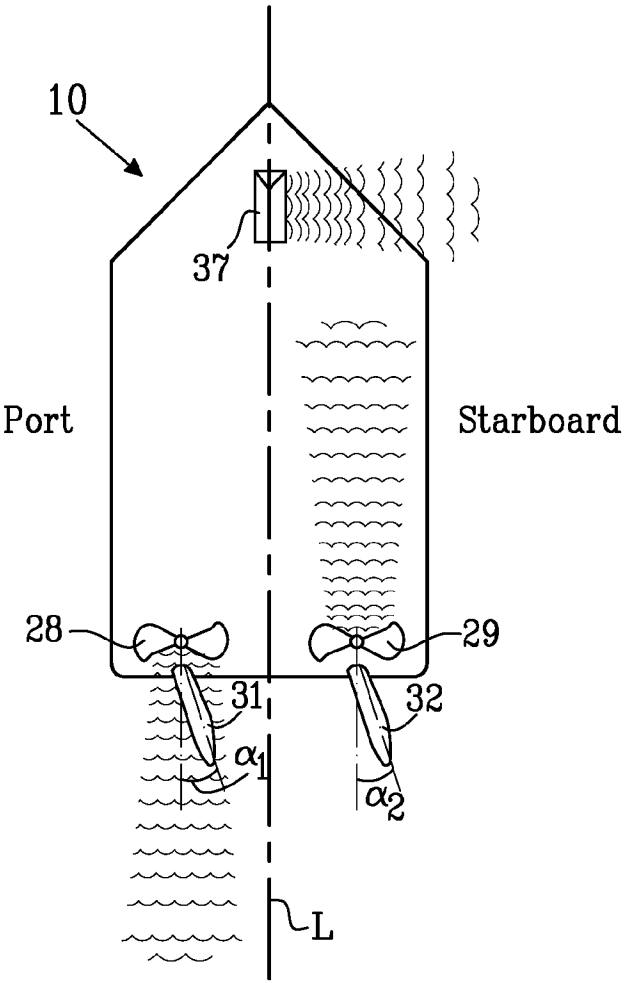
Figure 3:
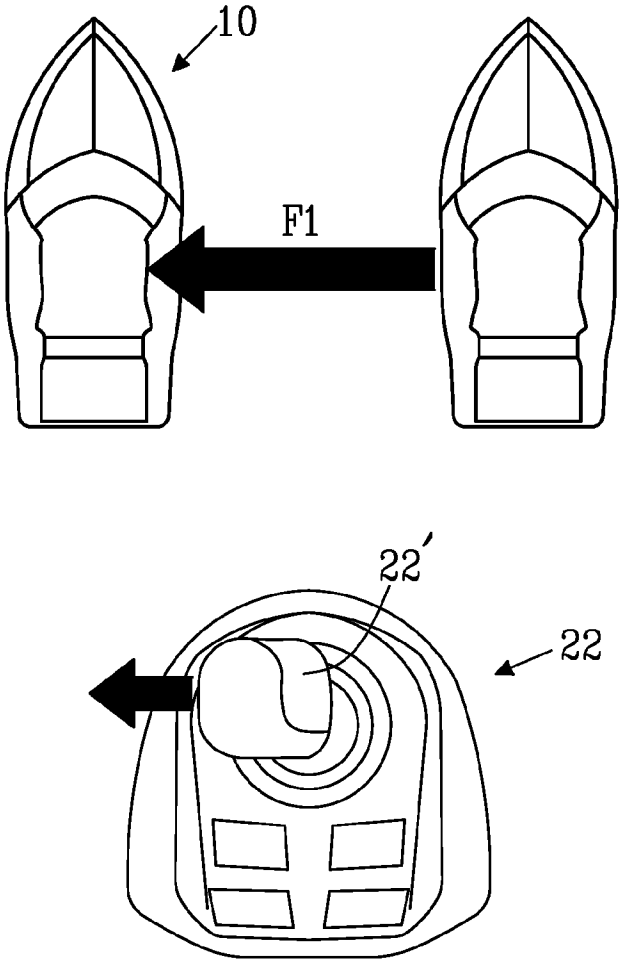

The following figures show the marine vessel 10 shown in FIG. 2, the same features having the same reference. FIG. 3 shows the marine vessel 10 during a sideway displacement in a port direction. The throttle response corresponds to current joystick port side position. The throttle is idle when the joystick is released. The gear of the port propulsion unit is in reverse and the gear of the starboard propulsion unit is in reverse. The bow thruster 37 thrusts at starboard when the joystick is in any port side position. No thrust is provided when the joystick is released. The rudder angle $\alpha 1$, $\alpha 2$ of the first and the second rudders 31, 32 are set to correspond to the port side position of the joystick to decrease/increase the side thrust, optionally centered when the joystick is released.

Figure 4:
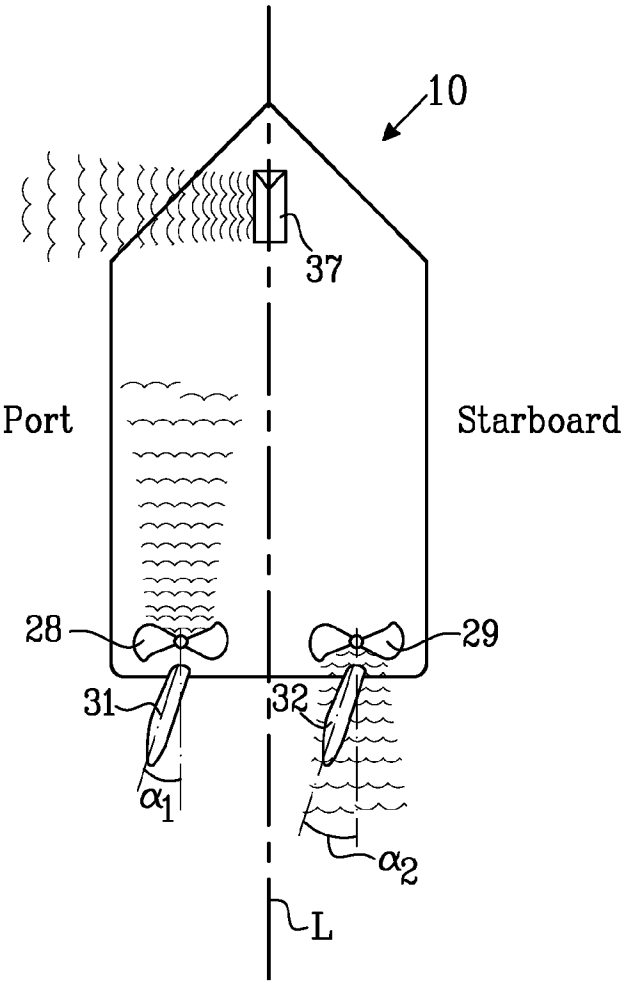
Figure 4:
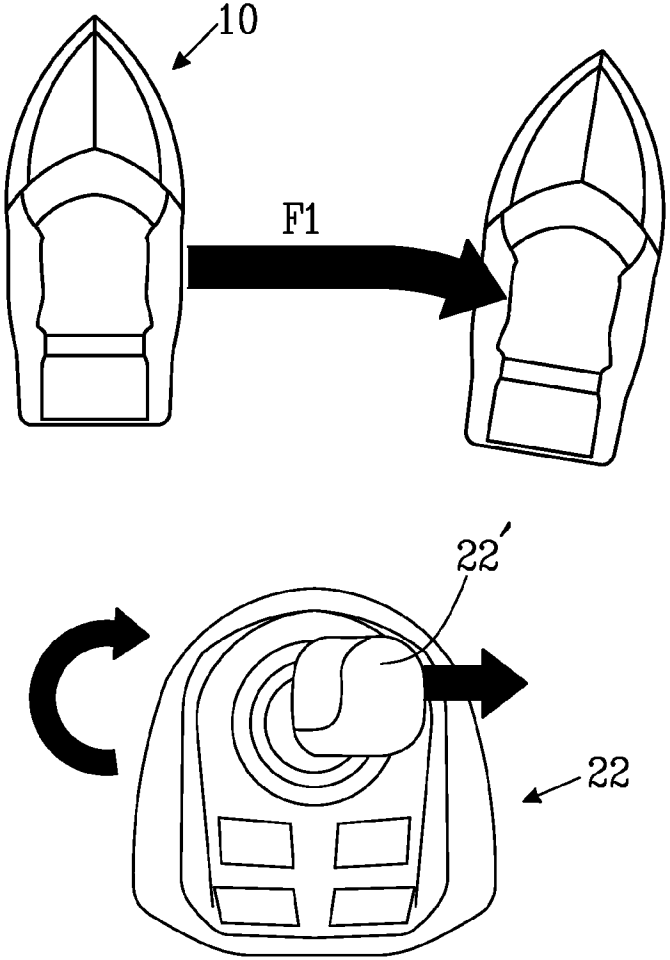

FIG. 4 illustrates a sideway displacement to starboard with a rotation compensation bow. The throttle response will correspond to the current joystick starboard side position and idle when the joystick is released. To perform the rotation compensation, the starboard propulsion unit will reduce the forward thrust e.g. by lowering the rotation speed of the propellers. The gear of the port propulsion unit will be in reverse and starboard propulsion unit in forward gear. Gear is switched to neutral when joystick 22 is released. The bow thruster 37 thrusts at port when the joystick is in any starboard position and cease to thrust when the joystick is released. The rudder angle $\alpha 1$, $\alpha 2$ of the port and starboard rudders 31, 32 correspond to the joystick position to decrease/increase the side thrust, and optionally center when the joystick is released. The rotation compensation bow is initiated by rotating the joystick 22 as shown by the arrow. When performing the rotation compensation bow, the rudder angles $\alpha 1$, $\alpha 2$ will decrease to thereby lower the stern thrust. Hence the joystick 22 is here used to initially set the rudder angles $\alpha 1$, $\alpha 2$ and subsequently to adjust the rudder angles $\alpha 1$, $\alpha 2$ to perform the rotation compensation bow maneuver.

Figure 5:
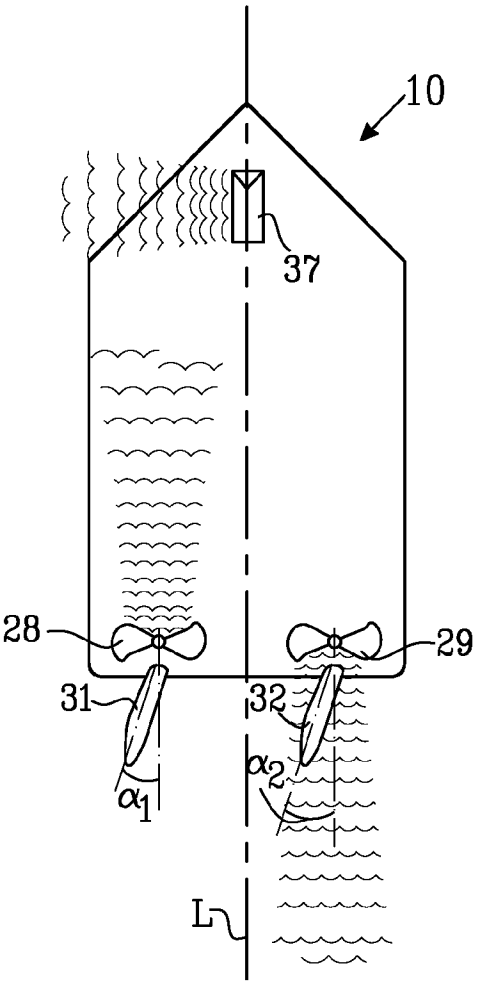
Figure 5:
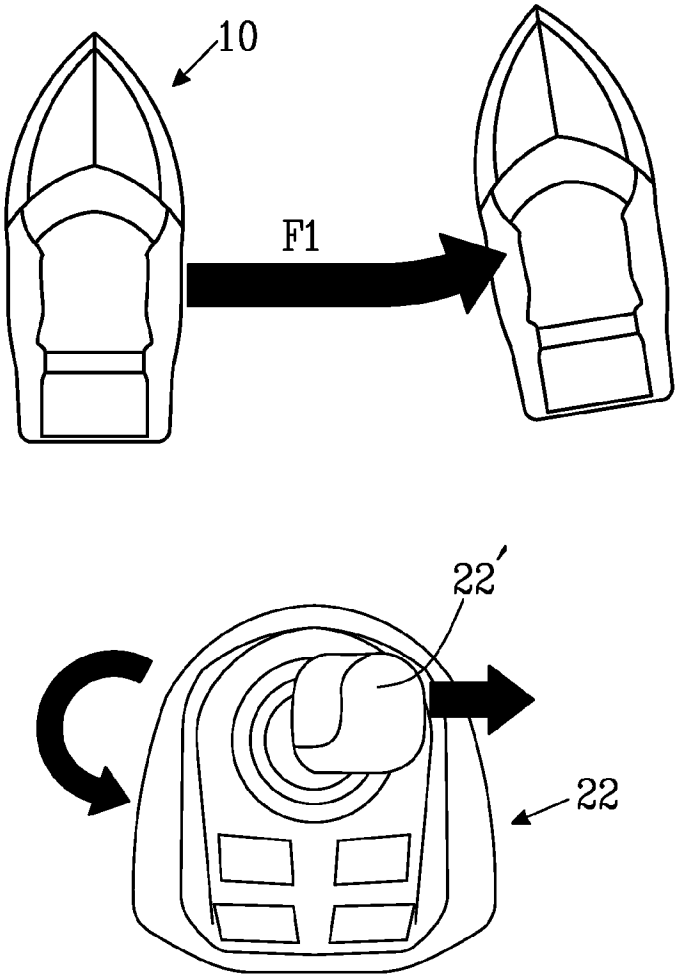

FIG. 5 illustrates a sideway displacement to starboard with a rotation compensation stern. The throttle response corresponds to the current joystick starboard side position, idle when the joystick is released. When performing the rotation compensation stern, the port propulsion unit will increase its revolutions to increase thrust from the port propulsion unit. The gear of the port propulsion unit is in reverse and the gear of the starboard propulsion unit is in forward. Gears are switched to neutral when the joystick is released.

The bow thruster 37 thrusts at port when the joystick is in any starboard position and cease to thrust when the joystick is released. The position of the rudders 31, 32, i.e. the rudder angles $\alpha 1$, $\alpha 2$, will initially correspond to the joystick starboard side position to decrease/increase the side thrust, and optionally center when the joystick 22 is released. When performing the rotation compensation stern maneuver, the bow thruster 37 will decrease thrust and the rudder angle $\alpha 1$, $\alpha 2$ of the first and the second rudder 31, 32 will increase to increase the stern thrust.

During the different displacements maneuvers illustrated in FIGS. 2-5, the rudder angle $\alpha 1$, $\alpha 2$ of the first and the second rudders 31, 32 are set as a function of the total thrust to steer the marine vessel 10 during the displacement, i.e. to decrease and/or increase the stern or side thrust. The displacement of the marine vessel 10 is operated via tilting the joystick 22, and as such, the rudder angles $\alpha 1$, $\alpha 2$ can thus be set as a function of the tilted position of the joystick. As disclosed above, the different positions of the joystick correspond to different thrust settings and can thus be correlated to set the angle $\alpha 1$, $\alpha 2$ of the first and the second rudders 31, 32.

Figure 6:
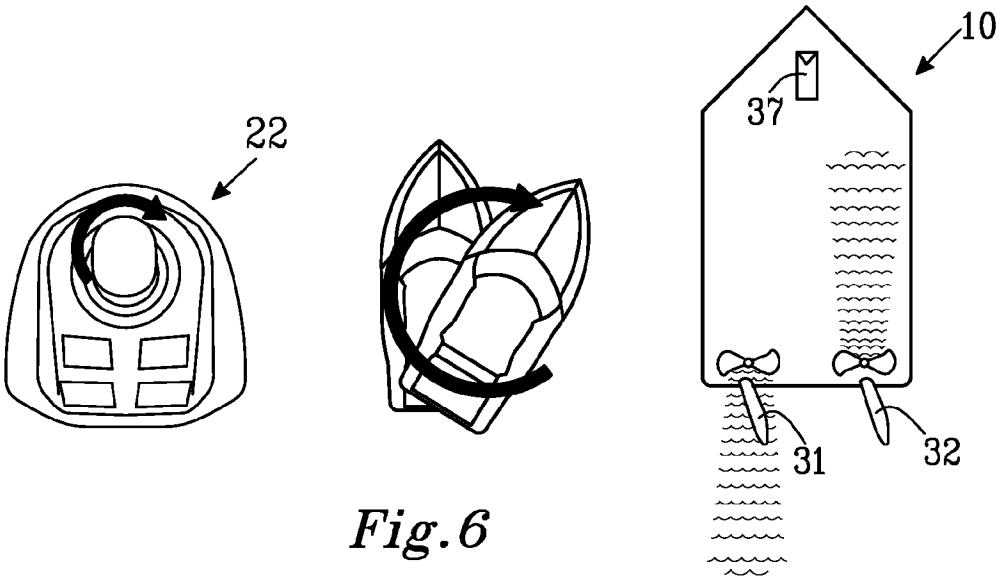
Figure 7:
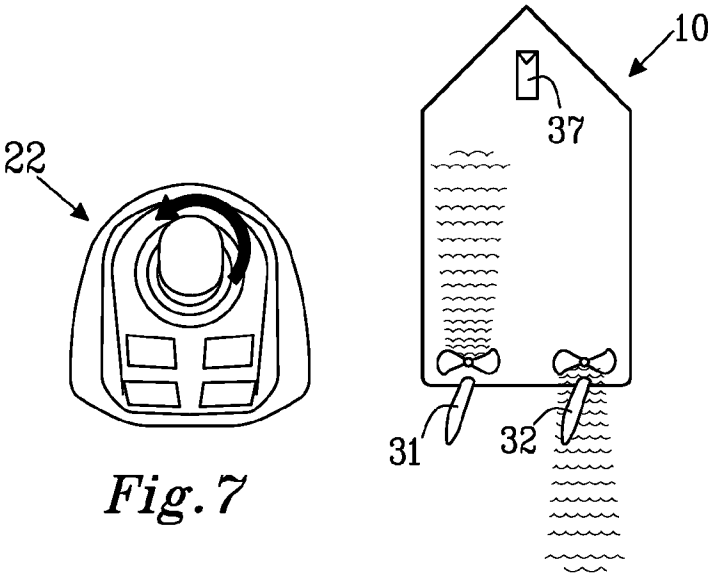

FIGS. 6 and 7 illustrate the marine vessel 10 during a clock-wise and counter clock-wise rotation but in comparison with the displacement described above, these maneuvers rely strictly on a rotation of the joystick 22. With reference to FIGS. 6-7, the throttle response will correspond to the current joystick rotation rate, or angle of rotation. The throttle is idle when the joystick 22 is released. The starboard propulsion unit is in forward gear and the port side propulsion unit is in reverse gear and vice versa depending on the desired rotation of the marine vessel. When the joystick 22 is released the gears are set to neutral. The bow thruster 37 is idle as the bow thruster is not used for rotation.

The first and the second rudders 31, 32 are set to an angle corresponding to the joystick rotation rate and/or to the angle of rotation of the joystick. The rudders are optionally centered when the joystick 22 is released.

Figure 8:
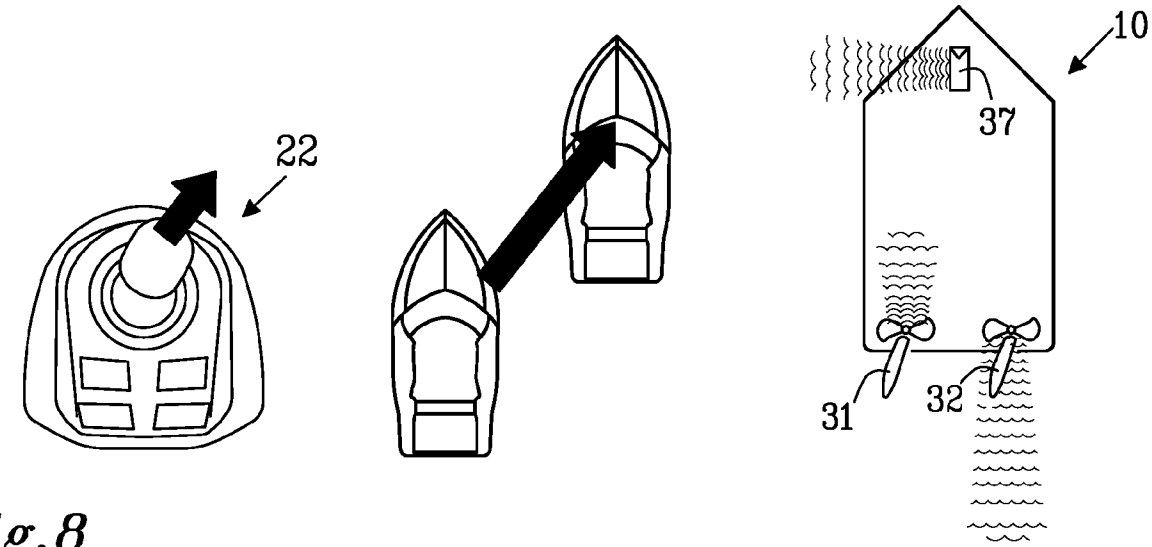
Figure 9:
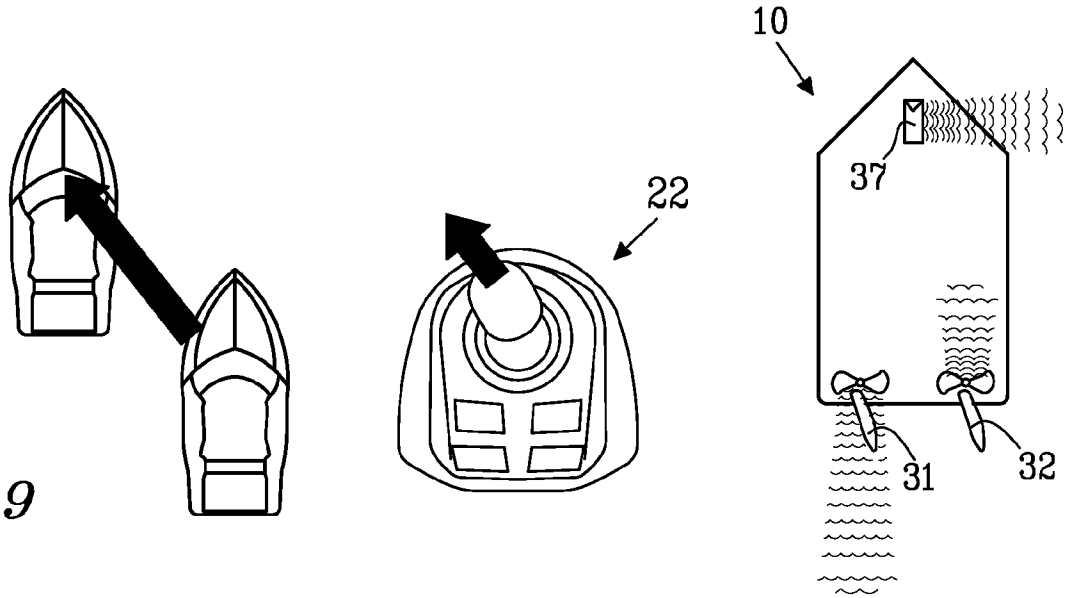

FIG. 8 illustrate the marine vessel 10 performing a forward side movement starboard and FIG. 9 a forward side movement port. The throttle response corresponds to the joystick position and forward side movement. The throttle is idle when the joystick is released. The gear of the port propulsion unit is in reverse and the gear of the starboard propulsion unit is in forward gear. The bow thruster 37 thrust at port when the joystick is off centre to starboard and no thrust when the joystick is released. The first and the second rudders 31, 32 may be used by setting different angles to counteract the marine vessels 10 rotation when moving forward sideways. The first and the second rudders 31, 32 may be centered when the joystick is released. In the shown embodiment, the rudders 31, 32 may be steered via rotation of the joystick, but is initially set at an angle as a function of the total thrust imparted on the marine vessel when tilting of the joystick. The same principle may be used to displace the marine vessel in a backward side movement port and starboard.

Figure 10:
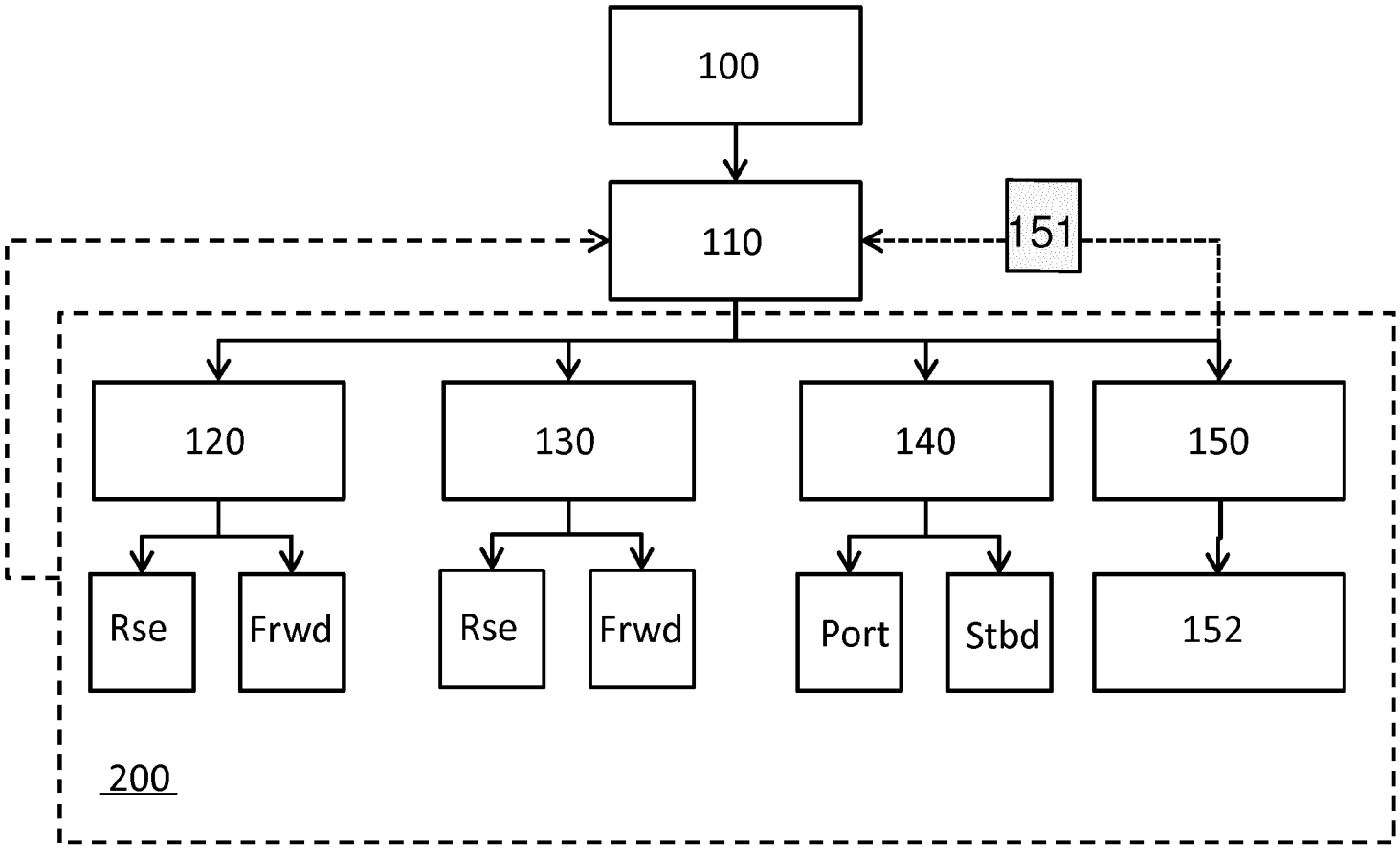
FIG. 10-12 show schematic block diagrams illustrating the method for performing a sideway displacement of a marine vessel.

FIG. 10 shows a schematic block diagram illustrating a non-limiting embodiment of the method for performing a sideway displacement of a marine vessel. At step 100 A driver operates the single driver interface, in this case a joystick, to move the marine vessel sideways straight to starboard. At 110 The steering and thruster control module receives the input signal carrying the displacement command via the single driver interface, in this case the joystick. When the steering and thruster control module has received the command signal, the steering and thruster control module actuates the first and the second propulsion units, i.e. the port and the starboard propulsion units, the bow thruster and the port and the starboard rudder in accordance with the received command.

At steps 120, 130 the port and starboard propulsion units are put in gear in accordance with the given command. In this case, the port propulsion unit 120 is put in reverse gear Rse and the starboard propulsion unit 130 is put in forward gear Frwd. The throttle is set to a corresponding value to the inclination of the joystick, i.e. with respect to the indicated value by the driver using the single driver interface.

At 140 The bow thruster thrusts at port, indicated by the reference Port in FIG. 10, thus pushing the bow in a starboard direction. The amount of thrust is set to a corresponding value to the inclination of the joystick, i.e. with respect to the indicated value by the driver using the single driver interface.

At 150 The rudder angle of the port and starboard rudders are set by a rudder actuator and in accordance with a preset value as a function on the total thrust. In this case, the rudder angle value is retrieved from a memory module 151, e.g. the steering and thrust control module. As an option, the rudder angle may be set to a corresponding value to the inclination of the joystick, i.e. with respect to the indicated value by the driver using the single driver interface. At step 152 the port and starboard rudders are operated in parallel to the set rudder angles.

200 indicate that a number of sensors are continuously detecting and forwarding measured values to the steering and thrust control module. The sensors may be one or more, but are advantageously sensors such as rudder angle sensors, fuel sensors, pressure sensors, temperature sensors and the like.

The method may be applied as a calibration method to provide suitable rudder angles as a function of a total thrust. More specifically the method may be a calibration method for calibrating the rudder angles of the first and the second rudders with the total thrust using a sideway displacement. It has been found to be advantageous to apply the disclosed method as a calibration method as it may set unique parameters for each marine vessel to provide a proper balance between the bow thruster(s), the rudders and the propulsion unit(s). Suitable parameters may be; rudder angles, amount of thrust such as propulsion unit throttle level, and gear, such as the propulsion units being in forward or reverse gear.

For the purpose of describing the calibration method in greater detail, reference will be made to FIG. 2. The marine vessel 10 in FIG. 2 is as illustrated operated to move in a straight starboard direction, but as will also be understood is that movement in straight port direction may also be used as shown in FIG. 3. The displacement may be used to provide a calibration method preferably from one or more selected parameters during such displacement. Such selected parameters may be stored in a storage module and subsequently be used for setting e.g. rudder angles or other devices.

The calibration method may be performed at a first level of thrust, and subsequently at a second level of thrust. Just as a matter of example, the calibration method may comprise displacing the marine vessel 10 at a first and a second speed in a straight port or starboard direction.

With reference to FIG. 2, the first calibration step may thus be to displace the marine vessel in a first direction at a first speed. The first speed is preferably relatively low, and may thus form to set the parameters for a low speed marine vessel movement. The throttle is thus set at low. The bow thruster thrust at port, the port propulsion unit put in reverse gear, the starboard propulsion unit put in forward gear and the port and starboard rudder angles $\alpha 1$, $\alpha 2$ are set to 0°. In this part, the balance between the thrust provided by the port and starboard propulsion units and the rudder angles $\alpha 1$, $\alpha 2$ set to 0° forming the stern thrust. The bow thrust is set to match the provided stern thrust by controlling the bow thrust proportionally from about 5-100%, but suitably between 5-20%, when the marine vessel 10 side movement is considered true parallel, as indicated by the arrow F1 in FIG. 2. The rudder angles and thrust levels are stored in a memory module.

During a second calibration step, the marine vessel 10 is displaced in the same direction as in the first calibration step but at a second speed, the second speed being different from the first speed, preferably higher. The second speed is preferably relatively high, and may thus form to set the parameters for a high speed marine vessel movement. The bow thruster 37 thrust at port, the port propulsion unit is put in reverse gear, the starboard propulsion unit is put in forward gear and the port and starboard rudder angles $\alpha 1$, $\alpha 2$ are set to 5-20° port such as approximately 10° port. The bow thrust is set to a fixed value of 90% of maximum but other fixed values may be applied such as 75% or higher of the maximum thrust. The thrust provided by the port and starboard propulsion units are balanced until the side movement of the marine vessel 10 is considered true parallel as indicated by the arrow F1 in FIG. 2. This operation will decide and set the maximum fast vessel maneuver.

To determine if the side movement is considered true parallel a navigation unit may be used, such as GPS. Optical measurement may further be performed.

The two calibration steps, represented by repeating the method twice, set the parameters for a fast and a slow displacement of the marine vessel, and represent extreme values, i.e. two ends of a scale. The rudder angles may be set linearly between these two ends.

When the two calibration steps are performed and implemented the driver only need to focus on compensating for wind and current if needed. If the maximum bow thrust is set to 90% of the maximum available thrust, a spare force of +10% in the thrust is available for the driver in order to provide the possibility for the driver to adjust the balance between stern and bow in real-time. The driver may further be permitted to reduce the bow thrust all the way down to 0%, to adjust for wind and currents. The adjustment is preferably done by rotating or tilting the joystick to compensate for wind and current during a sideway displacement maneuver of the marine vessel 10. In general terms, the method may include the option to perform a rudder angle compensation using the single driver interface. The rudder angle compensation may be ±5°, or preferably ±4°, more preferably ±3° depending on the hull, propellers and rudder size and shape. The joystick function is by this mapped between the two calibration points, and preferably linearly mapped between the two calibration points, i.e. the low speed maneuver and the high speed maneuver. This enables a driver to control the marine vessel 10 step less within the low speed and the high speed range (min to max) as desired.

The calibration method may be a powertrain calibration method and used in a marine vessel. The calibration method may comprise the steps:

Performing a first sideway displacement in which a first propulsion unit is in forward gear, and a second propulsion unit is in reverse gear.

The bow thruster and the first and the second rudders are balanced in order to set a low speed straight sideway, i.e. parallel, marine vessel displacement.

A low speed parallel marine vessel displacement may be defined by that the bow thrust is not exceeding 10% of the maximum thrust, such as the bow thruster is set to 1, 2, 3, 4, 5, 6, 7, 8, 9 or 10% of the maximum thrust depending on the hull, propellers and bow thruster size.

Performing a second sideway displacement in which the first propulsion unit is in forward gear, and the second propulsion unit is in reverse gear. The bow thruster and the first and the second rudders are balanced in order to set a high speed straight sideway, i.e. parallel, marine vessel displacement.

The bow thruster, the port and starboard propulsion units and the rudder angles of the first and the second rudder may be balanced with respect to each other in order to provide a straight sideway displacement of the marine vessel. In the first calibration step for example, the rudder angle of the first and the second rudder may be set to 0°, while in the second calibration step, the rudder angle of the first and the second rudder may be set to 5-20° port or starboard dependent on which direction the sideway displacement is directed.

Further, at a high speed marine vessel sideway displacement, the bow thrust power may be set to at least 75% of maximum, or 80, 85, 90% of maximum, i.e. full bow thrust power, and subsequently finding a balance between forward and reverse thrust of the port and starboard propulsion units. The bow thrust should however not exceed 90% of maximum thrust.

The first and the second calibration steps may be performed in reversed order of course, i.e. a high speed sideway displacement of the marine vessel may be performed before the low speed sideway displacement. Optionally the first two calibration steps may be followed by a mapping between calibrated parameters of the low speed sideway displacement and the high speed sideway displacement. The mapping may be a linear function or a non-linear function.

Figure 11:
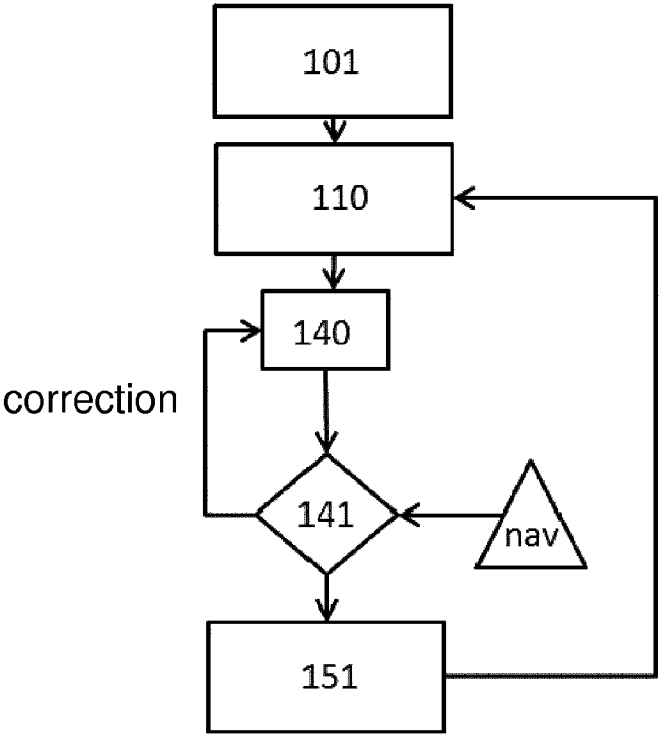

FIG. 11 shows a schematic block diagram of an embodiment of the calibration method to calibrate the rudder angles with respect to the total thrust. For the purpose of describing the calibration method, the sideway displacement shown in FIG. 2 will be used.

At step 101 in FIG. 11 a driver initiates the calibration command via the helm station of the marine vessel. The calibration command may be initiated via the single driver interface, or via an instrument panel at the helm station. In accordance with the calibration command, the driver is invited to displace the marine vessel in a straight starboard direction using the single driver interface. A signal may be issued to alert the driver that the calibration command has been initiated and that the marine vessel is ready to perform the calibration method.

At 110 in FIG. 11 and in accordance with the low speed calibration command for a starboard sideway displacement, the port propulsion unit is put in reverse gear and the starboard propulsion unit is put in forward gear at a set revs/min. The bow thruster is open for operation for the driver. The first and the second rudders are set to 0°. In this case a low speed calibration command was issued first. As an option, a high speed calibration command may initially be issued. The throttle is maintained below a threshold value.

At 140 in FIG. 11 the bow thruster is operable by the driver so as to balance the marine vessel so as to get a straight starboard displacement. 141 if a straight starboard displacement is not achieved, a signal will alert the driver to adjust the bow thruster until a straight starboard displacement is achieved. The determination may be performed by a navigation unit e.g. via GPS data, or optical measurements.

At 151 in FIG. 11 the data from the first and the second propulsion units, the bow thruster, the thrust level and the rudders are stored at a storage module 151 and available to the steering and throttle control module for later operations.

Figure 12:
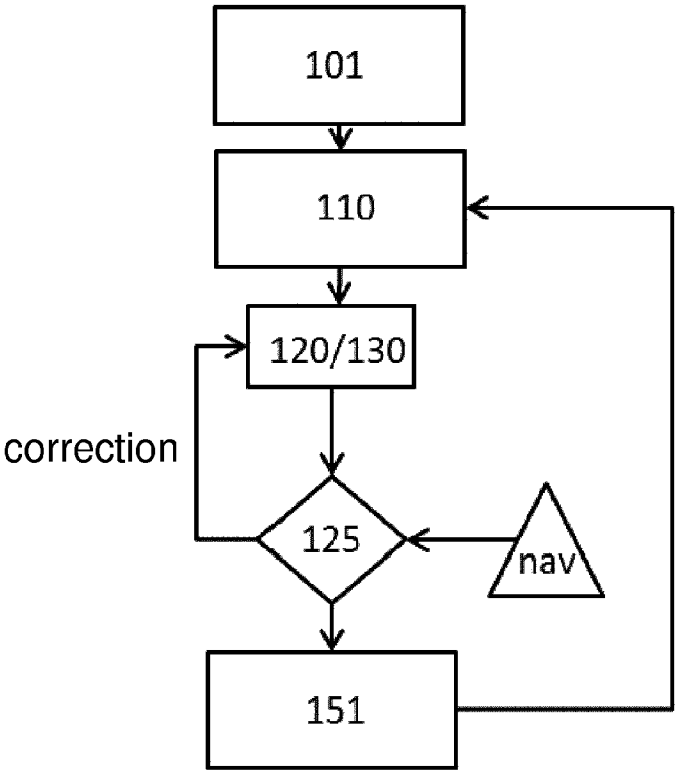

FIG. 12 shows a schematic block diagram of an embodiment of the calibration method to calibrate the rudder angles with respect to the total thrust. For the purpose of describing the calibration method, the sideway displacement shown in FIG. 2 will be used. Following the low speed displacement, a high speed displacement command is issued.

At step 110 in FIG. 12 and in accordance with the high speed calibration command for a starboard sideway displacement, the port propulsion unit is put in reverse gear and the starboard propulsion unit is put in forward gear. The bow thruster is set to 75% of maximum thrust. The first and the second rudders are set at a rudder angle of 5-20° port in this case about 8° port.

At steps 120/130 in FIG. 12 the first and the second propulsion units are operable by the driver so as to balance the marine vessel so as to get a straight starboard displacement. At step 125 if a straight starboard displacement is not achieved, a signal will alert the driver to adjust the bow thruster until a straight starboard displacement is achieved. The determination may be performed by a navigation unit e.g. via GPS data, or optical measurements.

At 151 in FIG. 12 the data from the first and the second propulsion units, the bow thruster, the thrust level and the rudders are stored at a storage module 151 and available to the steering and throttle control module for later operations.

The above described method may be performed any number of times such as one, two or three times or more.

It is to be understood that the present invention is not limited to the embodiments described above and illustrated in the drawings; rather, the skilled person will recognize that many changes and modifications may be made within the scope of the appended claims.

The invention claimed is:

1. A method for performing a sideway displacement of a marine vessel, said marine vessel comprising a first and a second propulsion unit, a first and a second rudder respectively associated with said first and said second propulsion units, and a bow thruster, said first and said second propulsion units, said first and said second rudders and said bow thruster being operable via a single driver interface, said method comprises via said single driver interface; operating said first and said second propulsion units and said bow thruster so as to provide a total thrust and setting rudder angles of said first and said second rudders, to thereby steer the sideway displacement of said marine vessel during said sideway displacement whereby said method is performed at a first level of thrust, and at a second level of thrust, whereby said first level of thrust is a low speed displacement and said second level of thrust is a high speed displacement, whereby at said first level of thrust, said rudder angles of said first and said second rudders are set to 0°, whereby at said second level of thrust, said rudder angles of said first and said second rudders are set parallel, and to a rudder angle of 5-20° port or starboard, whereby at said second level of thrust, said bow thruster is set to at least 75% of its maximum thrust.

2. The method according to claim 1, whereby said first and said second propulsion units each has a forward and a reverse gear, whereby said gears can be selected automatically in dependence of a driver operating said single driver interface.

3. The method according to claim 1, whereby setting said rudder angles is a function between said rudder angles and the level of thrust of at least said bow thruster.

4. The method according to claim 1, whereby said method comprises the step of setting the rudder angles of said first and said second rudders as a function of said total thrust.

5. The method according to claim 3, whereby said function is a mapped function such as a linear function or a non-linear function.

6. The method according to claim 1, whereby said sideway displacement is substantially a parallel sideway displacement.

7. The method according to claim 1, whereby said first and said second rudders are operated to be parallel with respect to each other during said sideway displacement.

8. The method according to claim 1, whereby said total thrust is provided by;

a thrust of said bow thruster and;

a forward thrust of said first propulsion unit and a rearward thrust of said second propulsion unit or;

a rearward thrust of said first propulsion unit and a forward thrust of said second propulsion unit.

9. The method according to claim 1, whereby said first and said second propulsion units have fixed thrust directions.

10. The method according to claim 1, whereby said sideway displacement is a sideway docking displacement.

11. The method according to claim 1, whereby said marine vessel has an inboard shaft line installation comprising a first and a second inboard shaft associated with said first and said second propulsion units respectively.

12. The method according to claim 1, whereby said single driver interface is a joystick, touch pad or the like.

13. The method according to claim 12, whereby said single driver interface is a joystick, and whereby a change of rudder angles of said first and said second rudders are associated with the rotation and/or tilting of said joystick.

14. The method according to claim 1, whereby said first and said second propulsion units are stern propulsion units.

15. The method according to claim 1, whereby said method is used to calibrate said rudder angles of said first and said second rudders with said total thrust, preferably by determining rudder angles as a function of said total thrust.

16. The method according to claim 15, whereby said method comprising the step of; storing the rudder angles at a first level of thrust, and storing the rudder angles at a second level of thrust.

17. The method according to claim 1, whereby said method comprises the step of; controlling and/or displacing said first and said second rudders to set said rudder angles.

18. A non-transitory computer readable medium carrying a computer program comprising program code, the program code performing a method for performing a sideway displacement of a marine vessel, said marine vessel comprising a first and a second propulsion unit, a first and a second rudder respectively associated with said first and said second propulsion units, and a bow thruster, said first and said second propulsion units, said first and said second rudders and said bow thruster being operable via a single driver interface, said method comprises via said single driver interface, when said program product is run on a computer:

operating said first and said second propulsion units and said bow thruster so as to provide a total thrust and setting rudder angles of said first and said second rudders, to thereby steer the sideway displacement of said marine vessel during said sideway displacement whereby said method is performed at a first level of thrust, and at a second level of thrust, whereby said first level of thrust is a low speed displacement and said second level of thrust is a high speed displacement, whereby at said first level of thrust, said rudder angles of said first and said second rudders are set to 0°, whereby at said second level of thrust, said rudder angles of said first and said second rudders are set parallel and to a rudder angle of 5-20° port or starboard, whereby at said second level of thrust, said bow thruster is set to at least 75% of its maximum thrust.

19. A marine vessel single driver interface steering arrangement, said marine vessel single driver interface steering arrangement comprising at least a first and a second propulsion unit, a first and a second rudder respectively associated with said first and said second propulsion units, and a bow thruster, where said marine vessel single driver steering arrangement is configured to enable a sideway displacement of a marine vessel via said single driver interface by;

operating said first and said second propulsion units and said bow thruster so as to provide a total thrust and;

setting rudder angles of said first and said second rudders to thereby steer the sideway displacement of said marine vessel during said sideway displacement, wherein said marine vessel single driver steering arrangement is configured to perform at a first level of thrust, and at a second level of thrust, whereby said first level of thrust is a low speed displacement and said second level of thrust is a high speed displacement, whereby at said first level of thrust, said rudder angles of said first and said second rudders are set to 0°, whereby at said second level of thrust, said rudder angles of said first and said second rudders are set parallel, and to a rudder angle of 5-20° port or starboard, whereby at said second level of thrust, said bow thruster is set to at least 75% of its maximum thrust.

20. The marine vessel single driver interface steering arrangement according to claim 19, wherein said first and said second propulsion units have fixed thrust directions.

21. The marine vessel single driver interface steering arrangement according to claim 19, wherein said marine vessel comprises an inboard shaft line installation comprising a first and a second inboard shaft associated with the first and the second propulsion units respectively.

22. The marine vessel single driver interface steering arrangement according to claim 19, wherein said rudder angles of said first and said second rudders are set as a function of said total thrust.

23. The marine vessel single driver interface steering arrangement according to claim 19, wherein said marine vessel single driver interface steering arrangement comprises a memory module for storing data relating to said rudder angles.

* * * * *